US007582030B2

(12) United States Patent
LaPergola

(10) Patent No.: US 7,582,030 B2
(45) Date of Patent: Sep. 1, 2009

(54) BASKETBALL TRAINING GLOVE

(76) Inventor: Gary LaPergola, 546 Walnut St., Audubon, NJ (US) 08106

( * ) Notice: Subject to any disclaimer, the term of this patent is extended or adjusted under 35 U.S.C. 154(b) by 111 days.

(21) Appl. No.: 11/746,985

(22) Filed: May 10, 2007

(65) Prior Publication Data

US 2008/0280705 A1 Nov. 13, 2008

(51) Int. Cl.
*A63B 31/02* (2006.01)
*A41D 19/00* (2006.01)
*A63B 69/00* (2006.01)

(52) U.S. Cl. ..... 473/450; 473/458; 473/464; 2/161.1; 2/19; D29/113

(58) Field of Classification Search ..... 473/59–60, 473/201, 205, 422, 450, 458, 464; 2/16, 2/161.1; 482/44, 47–49; 434/248; D29/113
See application file for complete search history.

(56) References Cited

U.S. PATENT DOCUMENTS 3,224,012 A * 12/1965 Hamm ..... 2/161.1
3,398,951 A * 8/1968 Disko ..... 473/61
3,595,575 A * 7/1971 Gooch ..... 473/61
3,707,730 A * 1/1973 Slider ..... 2/161.1
3,890,649 A * 6/1975 Diggins ..... 2/20
4,738,447 A * 4/1988 Brown ..... 473/450
4,881,275 A * 11/1989 Cazares et al. ..... 2/161.1
5,500,956 A * 3/1996 Schulkin et al. ..... 2/161.1
5,608,912 A * 3/1997 Cumberland ..... 2/16
5,970,521 A * 10/1999 Rabbeth ..... 2/161.1
6,049,910 A * 4/2000 McCarter ..... 2/161.1
6,093,165 A * 7/2000 Estwanik ..... 602/64
6,223,353 B1 * 5/2001 Lardieri, Jr. ..... 2/161.1
6,729,979 B1 * 5/2004 Sullivan ..... 473/450
7,210,172 B2 * 5/2007 Adams, Jr. ..... 2/163
7,399,240 B2 * 7/2008 Paukert et al. ..... 473/450
7,431,657 B2 * 10/2008 Whitehead et al. ..... 473/59
7,437,776 B1 * 10/2008 Brown ..... 2/160

* cited by examiner

*Primary Examiner*—Mitra Aryanpour
(74) *Attorney, Agent, or Firm*—Howard M. Gitten; Edwards Angell Palmer & Dodge

(57) ABSTRACT

A muscle memory training glove for basketball having a palm portion for covering the palm of the wearer's hand formed with a first opening for receiving the fingers and hands. A plurality of finger coverings communicate with the palm portion at a first end of the palm portion opposite the first opening. Each finger covering has an opening at a distal end thereof allowing the fingers of a user to extend therebetween. A separating structure maintains a respective one of each finger covering a predetermined spaced distance from an adjacent finger covering.

16 Claims, 5 Drawing Sheets

BASKETBALL TRAINING GLOVE

BACKGROUND OF THE INVENTION

This invention is directed to a training device for improving basketball shooting accuracy, and in particular, a glove for training by promoting muscle memory of the appropriate basketball grip and release.

As is known, a number of factors go into perfecting a basketball shot including footwork, positioning relative to the basket, and grip and hand positioning relative to the basketball. Often, a player is deficient in one if not more of these categories. The importance of grip and positioning are amplified when shooting shots such as foul shots when there is no movement so foot and body positioning becomes less complex. Therefore, it is desirous to teach proper hand positioning and grip of the basketball to increase the accuracy and precision of the shot.

It is also known that an effective way to train an athlete so that the appropriate action becomes automatic is through muscle memory training. Although there are numerous muscle memory devices including rubber bands, strings and the like for a variety of basketball skills, there has not been an effective muscle memory device for hand positioning and grip. Accordingly, a basketball training device that overcomes the shortcomings of the prior art by providing a muscle memory device for hand positioning and movement relative to the basketball is desired.

BRIEF SUMMARY OF THE INVENTION

A muscle memory glove for training basketball hand position and movement includes a palm covering having an opening at one end. A plurality of finger coverings communicate with the palm covering at a first end of the finger covering and extend substantially past a first knuckle of the user so as to have an opening at a distal end allowing the remainder of the finger to project therethrough. The finger coverings include a thumb covering communicating with the palm covering a portion of the thumb and allowing a substantial portion of the thumb to extend from an opening at a distal end of the thumb covering. A spacing structure is disposed across the finger covering to maintain a spacing between the respective fingers and the collection of fingers and thumb.

In a preferred embodiment, the spacing structure may be formed of a rigid member extending across and attached to each of the respective fingers. A second rigid member extends between an index finger covering and a thumb covering. The rigid member keeps the fingers spaced away from each other to form an angle having an arc of about 5°. Each finger may be provided with a stiffening member on an inner surface or ball facing surface of the finger or thumb covering to prevent bending of the finger at the knuckles.

In another alternative embodiment, the separating structure is provided by positioning members disposed between adjacent fingers, sized and shaped to separate the fingers at a substantially 5° angle from each other.

BRIEF DESCRIPTION OF THE DRAWINGS

For a fuller understanding of the invention, reference is had to the following description taken in connection with the accompanying drawing, in which.

DETAILED DESCRIPTION OF THE INVENTION

Figure 1:
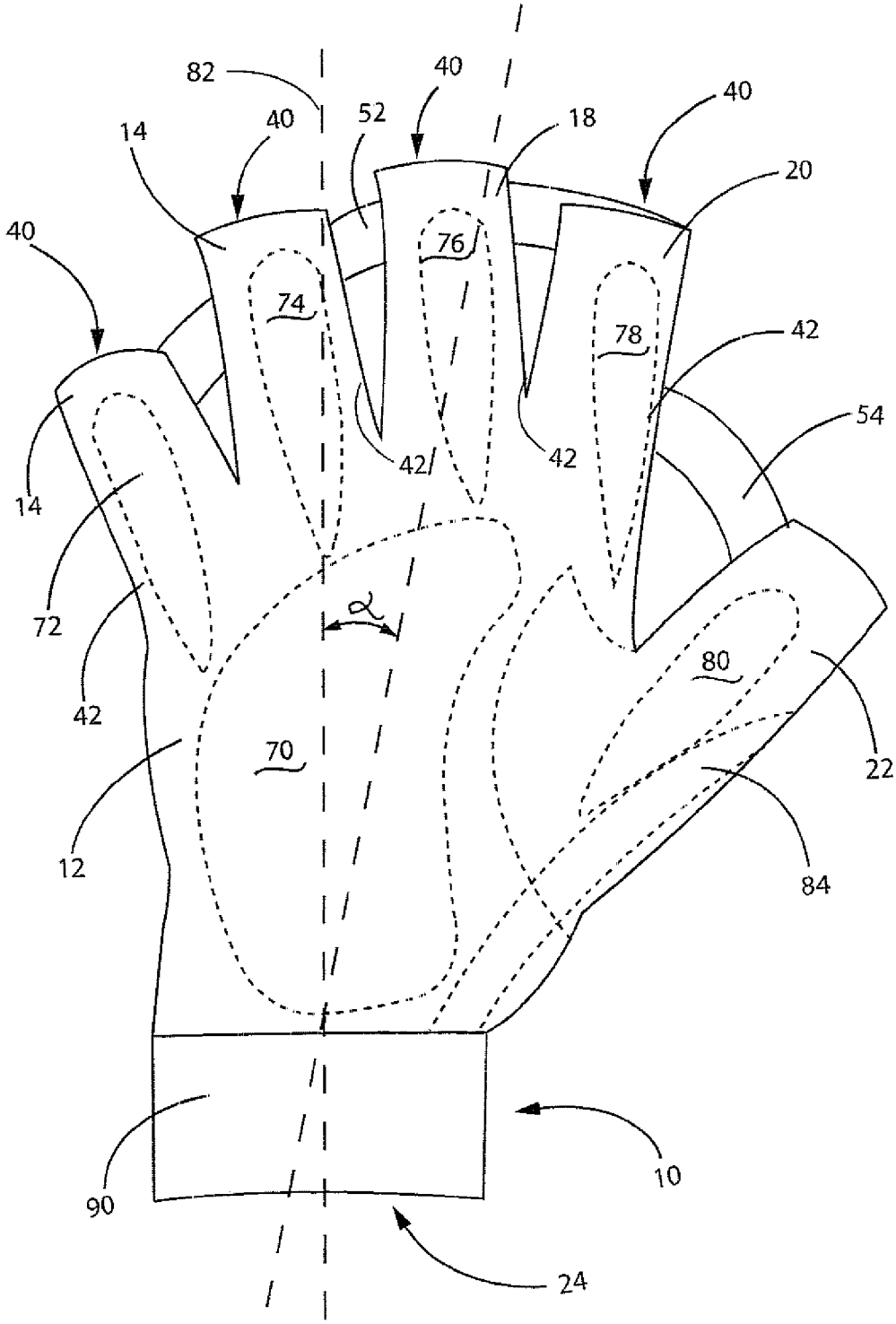
FIG. 1 is a front plan view of a training glove constructed in accordance with the invention.
Figure 2:
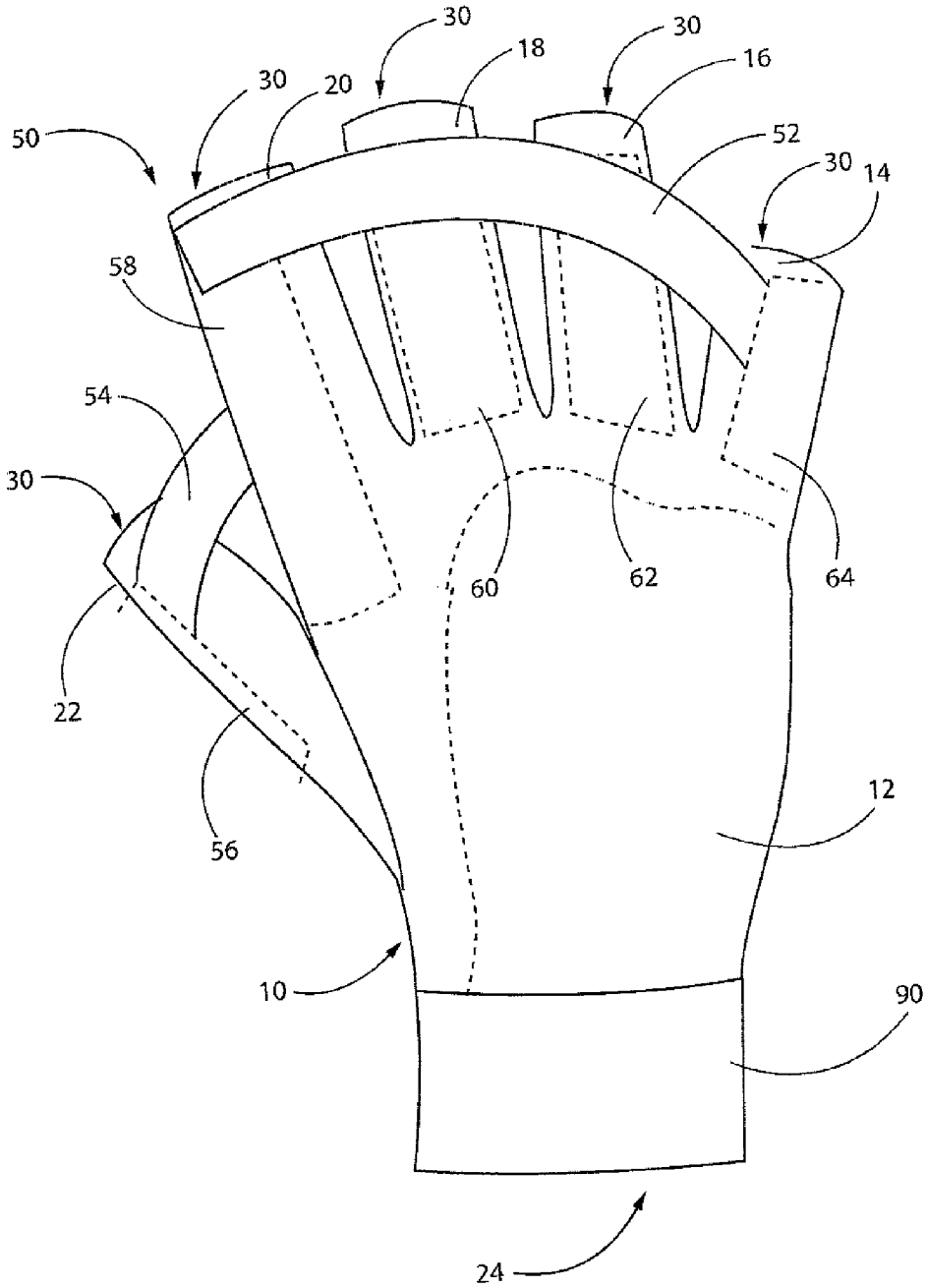
FIG. 2 is a rear plan view of a training glove constructed in accordance with the invention.

Reference is now made to FIGS. 1 and 2, wherein a basketball training glove, generally indicated as 10, constructed in accordance with the invention is provided. Glove 10 includes a palm covering 12 for covering and protecting the palm of the user. Palm covering 12 is provided with an opening 24 for receiving the hand of the user. Opening 24 extends below the wrist of a user's hand. Each of a user's fingers is partially enclosed in a respective pinky covering 14, ring finger covering 16, middle finger covering 18, index finger covering 20 and thumb covering 22, respectively and finger coverings 14-22 collectively.

Each finger covering 14-22 communicates with palm covering 12 through an opening 45 to allow a hand of the user to slide through opening 24, palm covering 12 and into respective finger coverings 14-22 in a single continuous motion. Each finger covering has a respective distal end 40 and a proximal end 42, which is adjacent palm covering 12 to communicate therewith. Distal end 40 has an opening allowing substantially all of the finger at or above the first knuckle to extend therefrom. The construction of each respective finger covering 14-22 is similar varying only in degree of length to accommodate the respective fingers.

A separating structure 50 includes in this first embodiment, by way of non-limiting structure, a first arced rigid member 52, which extends across finger coverings 14-20. Each of finger coverings 14-20 is provided with a respective anchor 58, 60, 62, 64, which is fastened along rigid member 52 to maintain finger coverings 14-20 in a fixed relative position. Rigid member 52 may be affixed to each anchor by a releasable fastening means such as a snap, Velcro® fastener (which allows substantially an infinite variety of positions) or the like. The spacing is adjustable.

Separating structure 50 includes a secondary rigid member 54, which separates thumb covering 22 from index finger covering 20 or palm covering 12. In a preferred embodiment, for reasons explained below, although rigid member 54 may be adjustable like member 52, it is preferably permanently anchored at a desired position between anchor 56 of thumb covering 22 and anchor 58 of index finger covering 20.

In a preferred embodiment, glove 10 includes a palm pad 70, which is curved and sufficiently rigid to maintain the hand in a slight curvature (shallow cup) and the palm of the user away from the ball when the glove is placed in facing relationship with ball 200. Stiffening pads 72-80 are also provided on an interior (ball facing) surface of each respective finger covering 14-22 to prevent over-bending of the fingers at the knuckles. It should be noted that separating rigid member 52 also inhibits bending of the fingers by anchoring all the fingers together. Furthermore, the distal end 40 of each finger coverings 14-22, extends to a length above the knuckle of the user to again inhibit bending of the fingers at the knuckle beyond a desired point.

Glove 10 includes a wristband 90 for securing the glove 10 about the wrist of the user and anchoring glove 10 to a hand of a user. A member 84, shown in phantom in FIGS. 1 and 4, couples the wristband 90 to the palm covering 12 and pushes the hand off a central axis 82 by an angle $\alpha$ of about 5° so the palm covering is forced to be slightly off center to the right, relative to an axis through the wrist of the user. Member 80 may be formed of any material sufficiently rigid to maintain the palm covering in the desired position, yet flexible enough to allow the hand to bend at the wrist to pass and shoot a ball.

Figure 3:
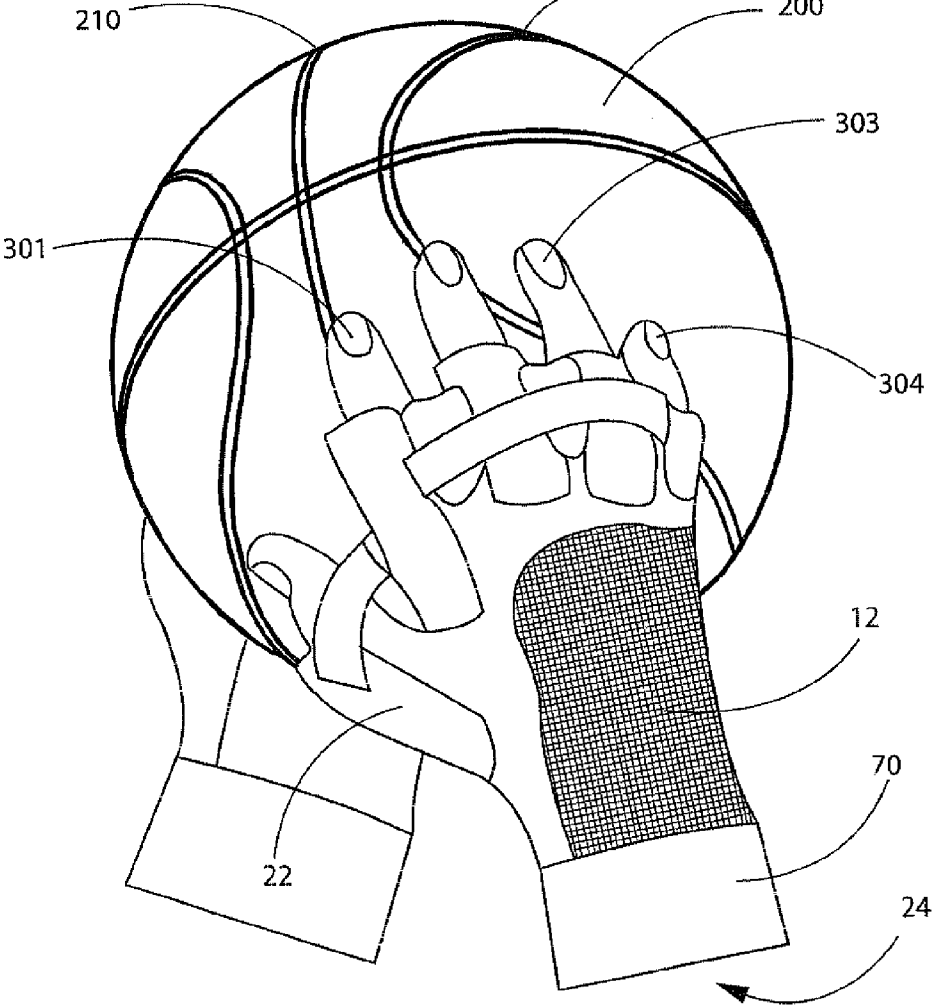
FIG. 3 is a perspective view of a training glove used in accordance with the invention.

Reference is now made to FIG. 3 in which use of glove 10 is illustrated. When gripping basketball 200, the shooting hand, as opposed to the steadying hand, should be presented at about a 5° angle to the right on a right-handed shooter, and conversely 5° to the left on a left-handed shooter. Accordingly, angle β between thumb covering 22 and index finger covering 20 is maintained at about 5° in the preferred non-limiting embodiment. The index finger 301 directs the ball, while the two outside fingers, pinky 304 and ring 303 are spread to the right for support and guidance. The palm of the hand is placed in the middle and only two fingers are placed on one of the seams 210 of basketball 200. The concept is to maintain the finger spread at a relative right angle. Therefore, structure 50 is utilized to provide a desired degree arc α of about 5° between the respective fingers. It is noted that α need not equal β or even equal each other.

The object of the invention is spreading the fingers, the appropriate hand structure for playing basketball. The larger the hand area the more control of the ball which improves not just shooting, but catching basketball 200 and dribbling basketball 200 as well. By providing the larger hand area there is more control in each of these activities. Use of the gloved hand, which maintains the hand in the appropriate, spread 5° orientation results in muscle memory so that enough repetitions allow the user to maintain the appropriate hand spacing and positioning even without the glove.

Figure 4:
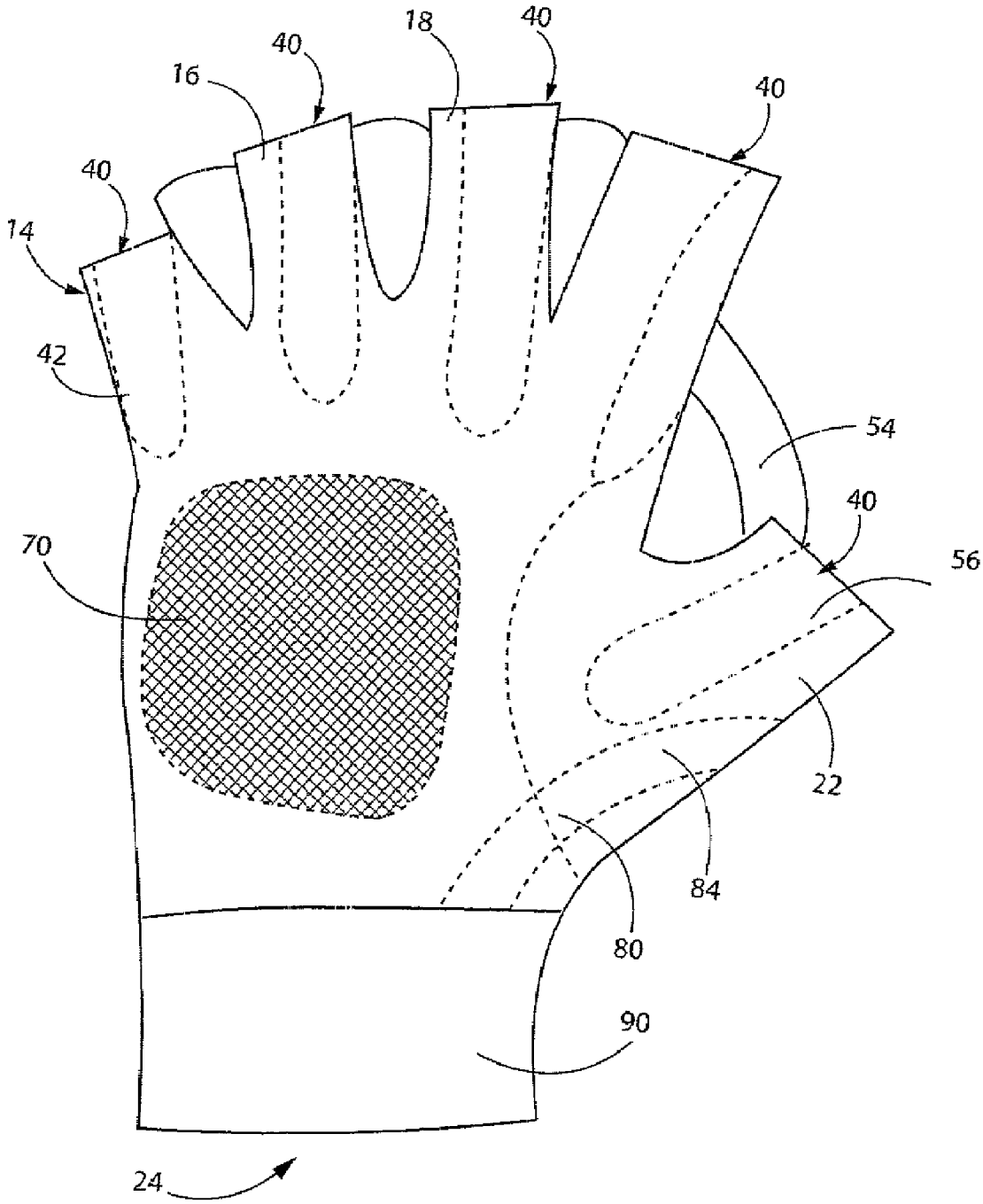
FIG. 4 is a front plan view of a training glove constructed in accordance with a second embodiment of the invention.
Figure 5:
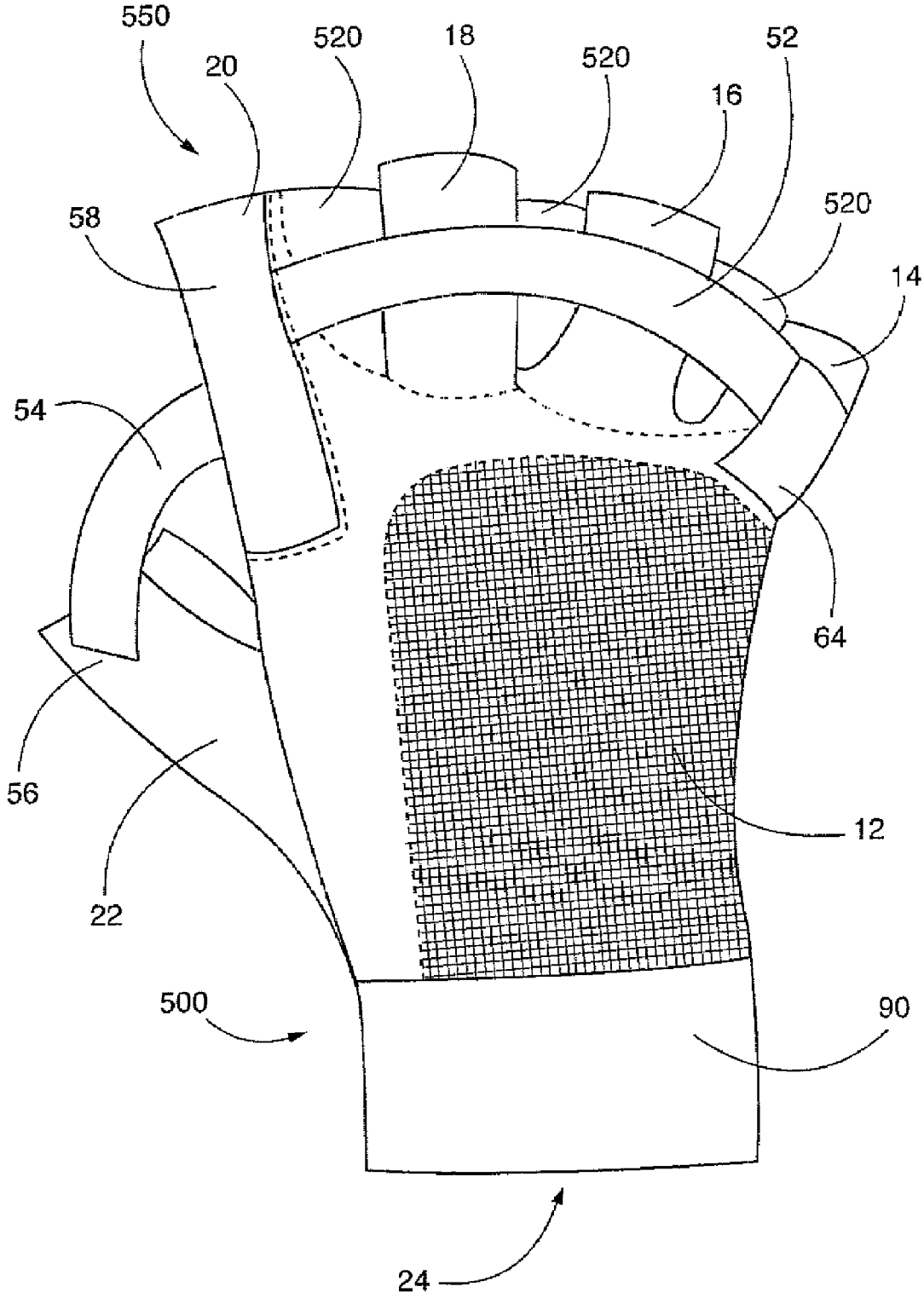
FIG. 5 is a rear perspective view of a training glove constructed in accordance with the second embodiment of the invention.

Reference is now made to FIGS. 4 and 5, in which a glove, generally indicated as 500, constructed in accordance with a second embodiment of the invention is provided. The primary difference being the addition of spacers between the individual fingers to further aid in the spacing and restriction of movement of individual fingers to train the hand in the appropriate basketball grip. Like numerals are utilized to indicate like structure.

Glove 500 has a palm covering 12 with fingers 14-22 extending therefrom. Support structure 550 again includes rigid arc support members 52 and 54, attached as discussed before, but additionally includes spacers 520 disposed between the pinky finger covering 14—ring finger covering 16 finger covering pair; ring finger covering 16 and middle finger covering 18 finger covering pair, and middle finger covering 18 and index finger 20 finger covering pair.

In a preferred embodiment, spacers 520 are formed of a padding or the like which supplies sufficient rigidity to prevent substantial lateral movement of the finger coverings towards each other. Spacers 520 are affixed to the respective finger coverings at either side and therefore provide additional stiffening and anchoring of the finger coverings at the predetermined spaces.

It should be noted that it is within the scope of the invention to provide spacers 520 without the need for rigid arced members 52 and 54. In other words arced members 52 and 54 are removable. By providing a glove which keeps the appropriate spacing and tilting of the hands and fingers, the performance of drills creates muscle memory for the proper hand positioning. The glove as a training device better facilitates the user's hand, and particularly the index finger, to guide the ball to the target during shooting, as opposed to aiming the ball which is detrimental to a good shot.

It will thus be seen that the objects set forth above, among those made apparent from the preceding description are efficiently attained and, since certain changes may be made from the above construction without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention, which, as a matter of language, might be said to fall therebetween.

What is claimed as new and desired to be protected by Letters Patent of the United States is:

1. A muscle memory training glove for basketball shooting comprising:

a palm portion for covering the palm of the wearer's hand formed with a first opening for receiving the fingers and hands;

a plurality of finger coverings communicating with the palm portion at a first end of the palm portion opposite the first opening, each finger covering having an opening at a distal end thereof allowing the fingers of a user to extend therefrom;

a thumb covering communicating with the palm portion;

a separating structure for maintaining a respective one of each finger covering a predetermined spaced distance from an adjacent finger covering and maintaining said thumb covering from said index finger covering; and an arced rigid member affixed to and extending across at least two of the finger coverings.

2. The glove of claim 1, wherein said plurality of finger coverings including at least the index finger covering and a second finger covering and said separating structure forms an angle of about 5° therebetween.

3. The glove of claim 1, wherein said finger coverings include at least an index finger covering and a second finger covering, and said arced rigid member is anchored to at least the index finger covering and at least a second finger covering.

4. The glove of claim 1, wherein the arced rigid member is selectively detachably affixed to said finger coverings.

5. The glove of claim 1, further comprising:

a second arced rigid member disposed between the index finger covering and said thumb covering.

6. The glove of claim 1, further comprising a pad disposed across an exterior surface of said palm covering and disposed so as to be in facing relationship with a basketball when the glove is in use.

7. The glove of claim 1, further comprising a stiffener disposed on at least one finger covering so as to be in facing relationship with a basketball when the glove is in use.

8. The glove of claim 1, further comprising a wrist portion and a member for providing an offset for the palm portion relative to the wrist portion.

9. The glove of claim 8, wherein the offset is about 5°.

10. A muscle memory training glove for basketball shooting comprising:

a palm portion for covering the palm of the wearer's hand formed with a first opening for receiving the fingers and hands;

a plurality of finger coverings communicating with the palm portion at a first end of the palm portion opposite the first opening, each finger covering having an opening at a distal end thereof allowing the fingers of a user to extend therefrom;

a separating structure for maintaining a respective one of each finger covering a predetermined distance from the adjacent finger covering;

a thumb covering communicating with the palm portion;

said separating structure including a plurality of spacers disposed between and affixed to each pair of adjacent finger coverings, and between said thumb covering and said finger coverings;

an arced rigid member affixed to and extending across at least two of the finger coverings; and a stiffener disposed on at least one finger covering so as to be in facing relationship with a basketball when the glove is in use.

11. A muscle memory training glove for basketball shooting comprising:

a palm portion for covering the palm of the wearer's hand formed with a first opening for receiving the fingers and hands;

a plurality of finger coverings communicating with the palm portion at a first end of the palm portion opposite the first opening, each finger covering having an opening at a distal end thereof allowing the fingers of a user to extend therefrom;

a separating structure for maintaining a respective one of each finger covering a predetermined distance from the adjacent finger covering;

a thumb covering communicating with the palm portion;

said separating structure including a plurality of spacers disposed between and affixed to each pair of adjacent finger coverings, and between said thumb covering and said finger coverings;

an arced rigid member affixed to and extending across at least one of the finger coverings;

a second arced rigid member disposed between an index finger covering and said thumb covering; and a stiffener disposed on at least one finger covering so as to be in facing relationship with a basketball when the glove is in use.

12. The glove of claim 11, wherein said finger coverings include at least an index finger covering and a second finger covering, said separating structure includes at least a first arced rigid member anchored to the least an index finger covering and the at least the second finger covering.

13. The glove of claim 10, further comprising a pad disposed across en exterior surface of said palm covering, and disposed so as to be in facing relationship with a basketball when the glove is in use.

14. The glove of claim 10, further comprising a wrist portion and a member for providing an offset for the palm portion relative to the wrist portion.

15. The glove of claim 14, wherein the offset is about 5°.

16. The glove of claim 10, further comprising a wrist portion and a member for providing an offset for the palm portion relative to the risk portion.

* * * * *